US011706560B2

(12) United States Patent
Lauridsen et al.

(10) Patent No.: US 11,706,560 B2
(45) Date of Patent: Jul. 18, 2023

(54) ADJUSTABLE SIDETONE AND ACTIVE NOISE CANCELLATION IN HEADPHONES AND SIMILAR DEVICES

(71) Applicant: Bang & Olufsen A/S, Struer (DK)

(72) Inventors: Knud-Erik Lauridsen, Herning (DK); John Hammer Madsen, Holstebro (DK)

(73) Assignee: Bang & Olufsen A/S, Struer (DK)

( * ) Notice: Subject to any disclaimer, the term of this patent is extended or adjusted under 35 U.S.C. 154(b) by 0 days.

(21) Appl. No.: 17/519,449

(22) Filed: Nov. 4, 2021

(65) Prior Publication Data

US 2022/0182750 A1 Jun. 9, 2022

(30) Foreign Application Priority Data

Dec. 7, 2020 (DK) ..... PA 2020 01373

(51) Int. Cl.
*H04R 1/10* (2006.01)

(52) U.S. Cl.
CPC ..... *H04R 1/1083* (2013.01); *H04R 1/1041* (2013.01); *H04R 2460/01* (2013.01)

(58) Field of Classification Search
CPC ..... H04R 1/1083; H04R 1/1041; H04R 2460/01; G10K 11/17881; G10K 2210/1081; G10K 2210/3056
USPC ..... 381/71.6
See application file for complete search history.

(56) References Cited

U.S. PATENT DOCUMENTS

| | | | | |
|---|---|---|---|---|
| 10,560,774 | B2 * | 2/2020 | Graylin | H04R 1/1041 |
| 10,757,240 | B1 * | 8/2020 | Hvidsten | G06F 3/167 |
| 2014/0341387 | A1 * | 11/2014 | Gauger, Jr. | H04R 1/1083 381/71.6 |
| 2016/0180830 | A1 * | 6/2016 | Lu | G10K 11/17885 381/71.6 |

* cited by examiner

*Primary Examiner* — Vivian C Chin
*Assistant Examiner* — Friedrich Fahnert
(74) *Attorney, Agent, or Firm* — Neal, Gerber & Eisenberg LLP; Thomas E. Williams

(57) ABSTRACT

A headphone device comprising active noise cancellation means (ANC) having a feedback (FB) signal path, a feed forward (FF) signal path and a sidetone signal path, where the headphone is provided with a control member (1, 11) that can be displaced or rotated between opposite positions, where the control member (1, 11) is configured such that the gain of the FF signal path and the gain of the sidetone signal path are controllable by the control member (1, 11) in such manner that when the control member (1, 11) is at one extreme position, the gain of the FF signal path is maximum and the gain of the sidetone signal path is minimum and when the control member (1,11) is at the opposite extreme position, the gain of the FF signal path is minimum and the gain of the sidetone signal path is maximum.

11 Claims, 2 Drawing Sheets

| | Sidetone | Feedforward ANC | Feedback ANC |
|---|---|---|---|
| Preset 1 | ON | OFF | ON |
| Preset 2 | OFF | OFF | ON |
| Preset 3 | OFF | ON | ON |

| I | II | III | IV | V | VI |
|---|---|---|---|---|---|
| | | | Calibration register gain | | |
| FB ANC (%) | FF ANC (%) | Sidetone (%) | FB (dB) | FF (dB) | Sidetone (dB) |
| 100 | 100 | 0 | 0 | 0 | -120 |
| 100 | 90 | 0 | 0 | -1 | -120 |
| 100 | 80 | 0 | 0 | -2 | -120 |
| 100 | 70 | 0 | 0 | -4 | -120 |
| 100 | 60 | 0 | 0 | -6 | -120 |
| 100 | 50 | 0 | 0 | -8 | -120 |
| 100 | 40 | 0 | 0 | -8,5 | -120 |
| 100 | 30 | 0 | 0 | -9 | -120 |
| 100 | 20 | 0 | 0 | -13 | -120 |
| 100 | 10 | 0 | 0 | -17 | -120 |
| 100 | 0 | 0 | 0 | -120 | -120 |
| 100 | 0 | 10 | 0 | -120 | -21 |
| 100 | 0 | 20 | 0 | -120 | -15 |
| 100 | 0 | 30 | 0 | -120 | -12 |
| 100 | 0 | 40 | 0 | -120 | -9 |
| 100 | 0 | 50 | 0 | -120 | -6 |
| 100 | 0 | 60 | 0 | -120 | -5 |
| 100 | 0 | 70 | 0 | -120 | -4 |
| 100 | 0 | 80 | 0 | -120 | -3 |
| 100 | 0 | 90 | 0 | -120 | -1,5 |
| 100 | 0 | 100 | 0 | -120 | 0 |

ADJUSTABLE SIDETONE AND ACTIVE NOISE CANCELLATION IN HEADPHONES AND SIMILAR DEVICES

CROSS REFERENCE TO RELATED APPLICATION

This application claims priority to Danish Application Number PA 2020 01373, filed on Dec. 7, 2020, which is incorporated herein by reference in its entirety.

TECHNICAL FIELD

The present invention relates generally to the field of headphones, headsets or earphones and more specifically to headphones, headsets or earphones provided with active noise cancelling (ANC).

BACKGROUND OF THE INVENTION

Many headphones, headsets and earphones are equipped with one or more microphones. These microphones are positioned in such a way that they can be used as voice microphone(s) during voice calls and/or as microphones for active noise cancellation (ANC).

When the user is wearing a headphone, headset or earphone the ear will typically be blocked physically by the device. This physical blocking will make it difficult for the user to hear his or her own voice clearly and with a natural timbre or sound quality during a voice call.

To compensate for this blocking, an amount of the sound of the user's own voice is transferred via the voice microphone(s) as an electrical signal to the loudspeaker(s) in the user's headphone, headset or earphone. This electrical signal is normally called sidetone.

Adding sidetone can create negative side effects when a headphone, headset or earphone is used in noisy or windy environments, as environmental noise or wind noise can be transferred to the loudspeaker(s) in the headphone, headset or earphone via the sidetone path.

Microphones used for voice pickup are often placed on the outside of the headphone, headset or earphone and can easily be exposed to wind, leading to undesired wind noise or distortion, which is clearly audible for the user via the sidetone path.

Active Noise Cancelling (ANC) headphones, headsets or earphones often use microphones placed on the outside of the headphone, headset or earphone as well as microphones placed on the inside of the headphone, headset or earphone.

Microphones on the outside of the headphone, headset or earphone will pick up ambient noise outside the headphone, headset or earphone to be used for the feed-forward part of the ANC system.

Microphones placed on the inside of the headphone, headset or earphone will pick up ambient noise inside the headphone, headset or earphone to be used for the feedback part of the ANC system.

The microphones on the outside of the headphone, headset or earphone are much more exposed to wind compared to microphones on the inside of the headphone, headset or earphone, which microphones are protected from exposure to the wind.

OBJECTS OF THE INVENTION

As the optimal balance between the feedback signal, the feed forward signal and the sidetone signal depends on the acoustical environment in which the headphone, headset or earphone is used as well as on user preferences, it is an object of the present invention to provide a headphone, headset or earphone comprising an active noise cancelling (ANC) system and a sidetone functionality that makes it possible for the user to obtain the above mentioned optimal balance no matter where and in which situations the headphone, headset or earphone is being used.

It is a further object of the present invention to provide a headphone, headset or earphone that is configured such that the optimal balance between the feedback signal, the feed forward signal and the sidetone signal can be adjusted by the user during use of the headphone, headset or earphone in a simple user-friendly manner.

DISCLOSURE OF THE INVENTION

Throughout the following description as well as in the claims the terms "headphone" or "headphone device" comprise both a headphone, a headset and an earphone as well as any similar head-worn or ear-worn device configured to pick up sound both in the outer ear of the user, when the user is wearing the device and in the environment immediately outside of the device.

The above and further objects and advantages are obtained by the provision of a headphone according to the invention.

During voice calls this invention makes it possible for the user to adjust the level of the sidetone and feed-forward ANC on the product itself to obtain the preferred balance according to the environment the headset is used in, such as quiet, noisy, or windy conditions.

In relatively quiet environments the user will typically prefer a maximum level or gain of the sidetone to be able to hear his or her own voice clearly and naturally.

In windy environments the user will typically prefer a setting where the level or gain of the sidetone and of the feed-forward part of the ANC system are both set to minimum—to minimize the transmission of wind noise to the loudspeaker(s) in the headset.

In very noisy environments the user will typically prefer a setting where the level or gain of the sidetone is set to minimum and the level or gain of the feed-forward ANC is set to maximum—to maximize noise cancellation.

At all settings, the level or gain of the feedback part of the ANC system will according to the present invention typically be at maximum to reduce the occlusion effect, i.e. to reduce the boomy sound of the user's own voice inside the head when the ears are blocked, but according to specific embodiments of the invention, also the level or gain of the feedback path can be varied.

According to the invention, the level or gain of the sidetone and/or the feed forward path can be varied smoothly (or in steps) with only a single control element (e.g. a rotating wheel/knob or a slider) on the product making it very easy for the user to obtain the optimum combination of the relative level or gain of the sidetone, the feed forward path and the feedback path according to precisely the acoustic environment in which the user is presently situated as well as to his or her specific preferences.

According to the invention, the above-mentioned and further objects and advantages are provided by a headphone device comprising active noise cancelling means (ANC) having a feedback (FB) signal path, a feed forward (FF) signal path and a sidetone signal path, where the headphone is provided with a control member that can be displaced or rotated between opposite positions, where the control member is configured such that the gain of the FF path and the gain of the sidetone path are controllable by the control member in such manner that when the control member is at one extreme position, the gain of the FF path is maximum and the gain of the sidetone path is minimum and when the control member is at the opposite extreme position, the gain of the FF path is minimum and the gain of the sidetone path is maximum.

In an embodiment of the invention, the gain of the feedback signal path FB is fixed at a predetermined value.

In an embodiment of the invention, the gain of the feedback signal path is variable.

In an embodiment of the invention, the control member is a rotary knob or similar member.

In an embodiment of the invention, the control member is a slider control, such as a touch bar.

In an embodiment of the invention, the control member is a + and − button which moves the the setting up and down a table of settings (as exemplified in the detailed description of the invention). The + and − button could be implemented as physical buttons or touch buttons.

In an embodiment of the invention, the sidetone and FF settings are operated by a touch panel or by one or more buttons.

In an embodiment of the invention, the headphone device comprises one single button or one single touch area configured such that the user can cycle through a table containing the on/off state or intermediate settings of the sidetone and FF signal paths thereby moving one row each time a button/area is pressed or touched.

In an embodiment of the invention, the headphone device comprises two buttons or touch areas configured such that the user can cycle through a table containing the on/off state or intermediate settings of the sidetone and FF signal paths thereby moving one row up each time one button/area is pressed or touched and moving one row down each time the other button/area is pressed or touched.

In the above embodiments, an intermediate setting could be any sidetone gain between 0% and 100% and similarly, any FF signal path gain between 0% and 100%.

In an embodiment of the invention, the control member is provided on the headphone.

In an embodiment of the invention, the control member is provided on a device that is in functional communication with the headphone.

BRIEF DESCRIPTION OF THE DRAWINGS

Further benefits and advantages of the present invention will become apparent after reading the detailed description of non-limiting exemplary embodiments of the invention in conjunction with the accompanying drawings, wherein.

DETAILED DESCRIPTION OF THE INVENTION

In the following a detailed description of an example embodiment of the invention is given. It is however understood that the principles of the invention could be embodied in other ways.

Figures 1, 2:
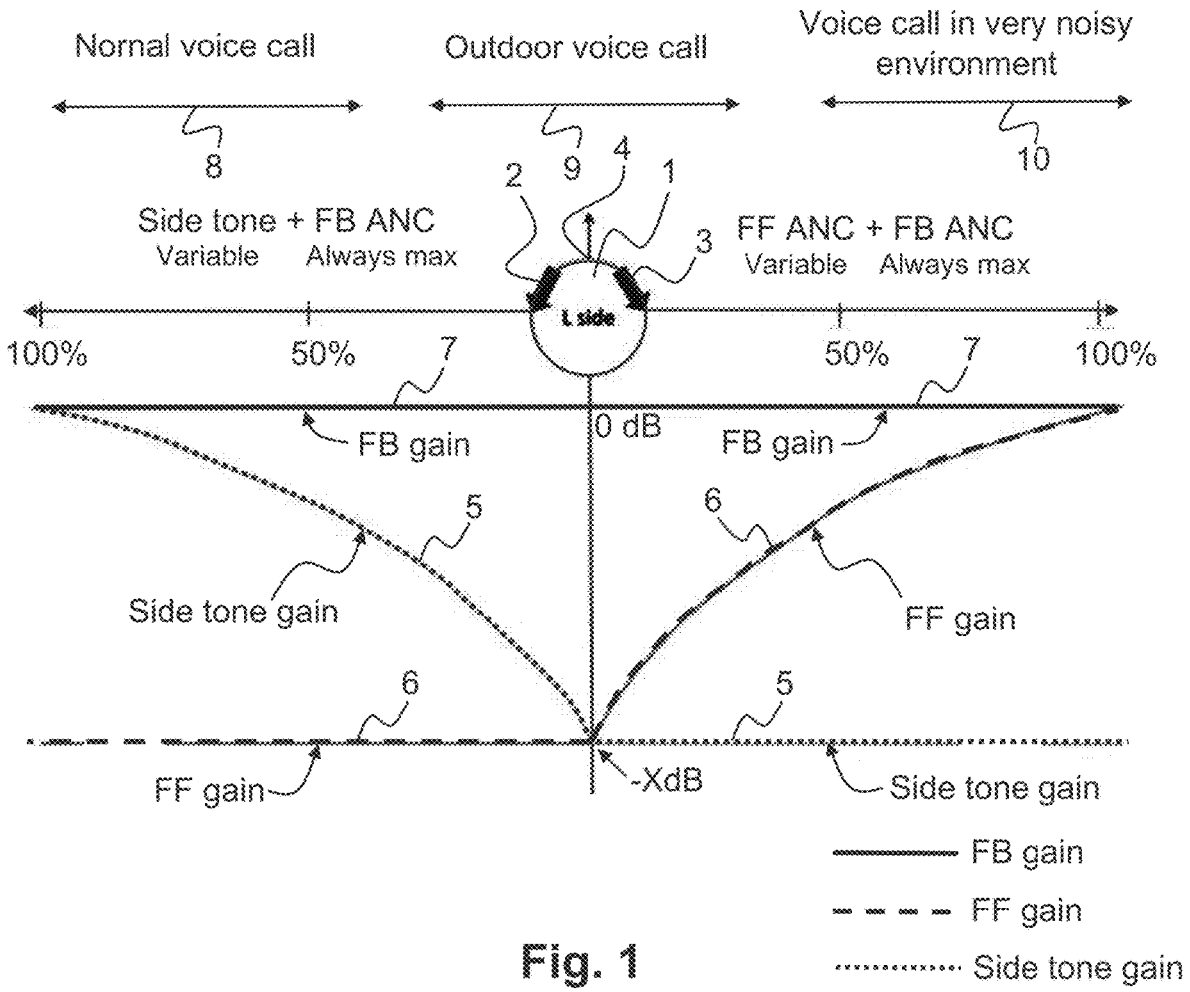
FIG. 1 shows a plot schematically illustrating the effect of adjusting a single user operable member on a headphone according to an embodiment of the invention.
FIG. 2 shows pre-set options that can be activated by for instance a press button or the like as an alternative to the continuous control provided by a rotatable knob or a slider bar.

With reference to FIG. 1 there is shown a plot that schematically illustrates the effect of adjusting a single user operable member 1 (in this example embodiment a rotatable knob) provided on a headphone according to an embodiment of the invention. FIG. 1 shows the gain of the sidetone path and the gain of the feed forward path as a function of the rotation of the control knob 1. In the embodiment of the invention shown in FIG. 1, the gain of the feedback path is constant and equal to 0 dB (its maximum value).

As schematically illustrated in FIG. 1, when the control knob 1 is rotated from the middle position 4 counter-clockwise 2, the gain 5 of the side tone path increases from a very low level (−X dB) to the same level (0 dB) as the gain 7 of the feedback path. When the control knob 1 is at any position from the middle position 4 and to the extreme counter-clockwise position, the gain 6 of the feed forward path remains at the very low level (−X dB). Hence, when the control knob 1 is rotated counter-clockwise 2 from the middle position 4, the user of the headphone is substantially only presented with the effect of the sidetone and the feedback path.

As indicated in FIG. 1, a rotation of the control knob 1 to large counter-clockwise positions (between about 40 and 100% counter-clockwise) in the figure would be the adjustment of the control knob 1 that a user would typically choose during normal voice calls 8, i.e. during voice calls in substantially quiet surroundings without wind noise.

When the control knob 1 is rotated from the middle position 4 clockwise 3, the gain 6 of the feed forward path increases from a very low level (−X dB) to the same level (0 dB) as the gain 7 of the feedback path. When the control knob 1 is at any position from the middle position 4 and to the extreme clockwise position, the gain 6 of the sidetone path remains at the very low level (−X dB). Hence, when the control knob 1 is rotated clockwise 3 from the middle position 4, the user of the headphone is substantially only presented with the effect of the feed forward and the feedback path.

As indicated in FIG. 1, a rotation of the control knob 1 to large clockwise positions (between about 40 and 100% clockwise) in the figure would be the adjustment of the control knob 1 that a user would typically choose during voice calls in very noisy environments 10.

As indicated in FIG. 1, a rotation of the control knob 1 to mid-wise positions (between 40% counter-clockwise and 40% clockwise) in the figure would be the adjustment of the control knob 1 that a user would typically choose during outdoor voice calls 9.

In an embodiment of the invention, during a voice call, it is proposed to use the below settings (c.f. FIG. 1):

1) FB ANC is always active irrespective of control knob 1 rotation or slider position.

2) Turning the control knob 1 clockwise 3 from the middle position 4—or displacing a corresponding slider control member from its middle position towards one side—will change the gain or level of FF ANC from −X dB to 0 dB (0 to 100% FF ANC).

3) Turning the control knob 1 counter-clockwise 2 from the middle position 4—or displacing a corresponding slider control member from its middle position towards the opposite side—will change the sidetone gain or level From −X dB to 0 dB (0 to 100% sidetone)

Alternatively, the sidetone and FF ANC could also be operated by a touch panel or by one or more buttons as described below.

In case of a single button or one single touch area, the user would for instance cycle through a table of settings, such as the one shown in FIG. 2, moving one row for each button press/touch.

In case of two buttons, one button could be configured to move one row up in the table and the other button could be configured to move one row down in the table.

During a voice call the user can select different presets for sidetone and feed-forward ANC settings on the product itself (by toggling between 3 or more presets, for instance 5 or more rows, to facilitate a finer adjustment resolution) to obtain the preferred setting according to the environment the headset is used in, such as quiet, noisy, or windy conditions.

Preset 1: In relatively quiet environments, the user will typically prefer to have maximum (100%) sidetone to be able to hear his or her own voice clearly and naturally.

Preset 2: In windy environments the user will typically prefer a setting where the sidetone and the feed-forward part of the ANC system are both set to minimum (0%)—to minimize wind noise.

Preset 3: In very noisy environments the user will typically prefer a setting where the sidetone is set to minimum (0%) and the feed-forward ANC is set to maximum (100%)—to maximize noise cancellation.

In all presets, the feedback part of the ANC system will typical be at maximum (100%) to reduce the occlusion effect, i.e. to reduce the boomy sound of own voice inside the head when the ears are blocked.

With reference to FIG. 2 there is shown a table of preset options that can be activated by for instance a press button or the like as an alternative to the continuous or stepwise control provided by a rotatable knob or a slider bar corresponding to Preset 1 through 3 mentioned above.

Figure 3:
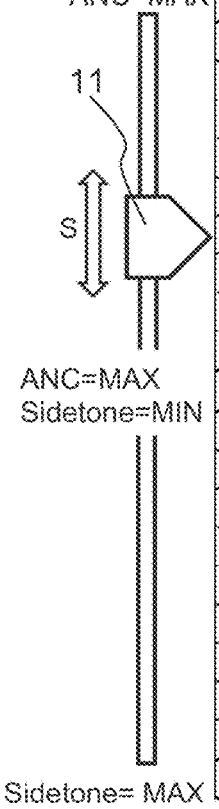
FIG. 3 shows an example of a gain table used in an embodiment of the invention.

With reference to FIG. 3 there is shown an example of a gain table used in an embodiment of the invention. It is however understood that other numerical values than those given in the table can be used and that such values would also fall within the scope of the invention.

The table comprises six columns I, II . . . VI. Column I show the effect of the feedback ANC expressed in percent and column II similarly shows the effect of the feed forward ANC in percent. Column III shows the amount of sidetone also expressed in percent. Columns IV, V and VI show the respective gains of the feedback (FB) signal path, the feed forward (FF) signal path and the sidetone signal path expressed in dB.

FIG. 3 further illustrates that the choice of ANC and Sidetone settings—and hence the choice of the respective gains—can be obtained by the user by means of a single control member, in the figure by means of a slide bar 11 (for instance a touch bar) that, when displaced as indicated by arrow S from one extreme position providing maximum ANC effect and no sidetone effect to the other extreme position giving no feed-forward ANC effect and maximum sidetone effect, determines the balance between the FB, FF and sidetone contributions to the acoustic output from the headphone. Hereby the user can obtain the combination of these contributions that he or she judges to be the best according to the acoustic environment in which the headphone is being used as well as to the user's specific preferences. It is of course understood that other control means, such as the rotatable knob 1 in FIG. 1, could be used as an alternative to the slide bar 11.

References 5 (FIG. 1), 6 (FIGS. 1) and 7 (FIG. 1) indicate that the gain values shown in the respective of these columns corresponds to the curves 5, 6 and 7 respectively in FIG. 1.

The invention claimed is:

1. A headphone system comprising:

active noise cancelling means (ANC) having a feedback (FB) signal path, a feed forward (FF) signal path, and a sidetone signal path; and a control member that can be displaced or rotated between opposite positions, wherein the control member is configured to control a gain of the FF signal path and a gain of the sidetone signal path, wherein, when the control member is at a first extreme position, the gain of the FF signal path is at a maximum level and the gain of the sidetone signal path is at a minimum level, wherein, when the control member is at a second, opposite extreme position, the gain of the FF signal path is at a minimum level and the gain of the sidetone signal path is at a maximum level, wherein, when the control member is rotated or displaced from a middle position in a first direction, the gain of the sidetone signal path increases gradually from said minimum level to said maximum level and the gain of the FF signal path remains at said minimum level, and wherein, when the control member is rotated or displaced from the middle position in a second direction opposite the first direction, the gain of the FF signal path increases gradually from said minimum level to said maximum level and the gain of the sidetone signal path remains at said minimum level.

2. The headphone system according to claim 1, wherein the gain of the feedback signal path is fixed at a predetermined value.

3. The headphone system according to claim 1, wherein the gain of the feedback signal path is variable.

4. The headphone system according to claim 1, wherein the control member is a rotary knob.

5. The headphone system according to claim 1, wherein the control member is a slider control.

6. The headphone system according to claim 1, wherein the control member includes a touch panel or one or more buttons.

7. The headphone system according to claim 1, wherein the control member includes one single button or one single touch area configured to enable the user to cycle through a table containing an on/off state or intermediate settings of the sidetone signal path and the FF signal path to move one state or setting each time the single button or the single touch area is pressed or touched.

8. The headphone system according to claim 1, wherein the control member includes two buttons or touch areas configured to enable the user to cycle through a table containing an on/off state or intermediate settings of the sidetone signal path and the FF signal path to move one state or setting up each time one of the two buttons or touch areas is pressed or touched and moving one state or setting down each time the other of the two buttons or touch areas is pressed or touched.

9. The headphone system according to claim 1, wherein the control member is located on the headphone.

10. The headphone system according claim 1, wherein the control member is located on a device that is in communication with the headphone.

11. The headphone system according to claim 1, wherein a gain of the FB signal path defines said maximum level of the gain of the FF signal path and said maximum level of the gain of the sidetone signal path.

* * * * *